US012304699B2

(12) United States Patent
Kuo et al.

(10) Patent No.: US 12,304,699 B2
(45) Date of Patent: May 20, 2025

(54) SUNKEN-TYPE CUP LID

(71) Applicant: Golden Arrow Printing Technology (Kunshan) Co., LTD., Kunshan (CN)

(72) Inventors: Chien-Kuan Kuo, New Taipei (TW); Chun-Huang Huang, New Taipei (TW)

(73) Assignee: GOLDEN ARROW PRINTING TECHNOLOGY (KUNSHAN) CO., LTD., Kunshan (CN)

( * ) Notice: Subject to any disclaimer, the term of this patent is extended or adjusted under 35 U.S.C. 154(b) by 15 days.

(21) Appl. No.: 18/217,606

(22) Filed: Jul. 2, 2023

(65) Prior Publication Data

US 2024/0076105 A1 Mar. 7, 2024

(30) Foreign Application Priority Data

Sep. 1, 2022 (CN) ..... 202222340198.0

(51) Int. Cl.
*B65D 43/02* (2006.01)
*B65D 47/06* (2006.01)

(52) U.S. Cl.
CPC ..... *B65D 43/022* (2013.01); *B65D 47/06* (2013.01); *B65D 2543/00046* (2013.01); *B65D 2543/00092* (2013.01); *B65D 2543/00268* (2013.01); *B65D 2543/00351* (2013.01); *B65D 2543/00509* (2013.01); *B65D 2543/0099* (2013.01)

(58) Field of Classification Search
CPC ..... B65D 43/022; B65D 47/06; B65D 2543/00046; B65D 2543/00092; B65D 2543/00268; B65D 2543/00351; B65D 2543/00509; B65D 2543/0099
See application file for complete search history.

(56) References Cited

U.S. PATENT DOCUMENTS 1,706,007 A * 3/1929 Van Alstyne et al. ..... B65D 43/021 229/404
1,846,310 A 2/1932 Chaplin
3,722,784 A * 3/1973 Harper ..... B65D 43/022 229/404
4,303,170 A * 12/1981 Panicci ..... A47G 19/2272 220/717
4,388,996 A * 6/1983 Panicci ..... A47G 19/2272 215/373

(Continued)

FOREIGN PATENT DOCUMENTS

WO 2020/016411 A1 1/2020

*Primary Examiner* — James N Smalley
(74) *Attorney, Agent, or Firm* — Cheng-Ju Chiang

(57) ABSTRACT

A sunken-type cup lid, for covering on a cup mouth of a cup body, according to the present invention is disclosed herein, and comprises: a covering panel, a leaning-on portion and a camber-holding portion. On the covering panel, a sunken-type dome structure is formed to expand a contacting area, from the leaning-on portion laterally and tightly fitting against inside the cup body, to the camber-holding portion downwardly and tightly fitting overneath the cup mouth, so as to be in a multi-directional tight fit manner between the cup lid and the cup body. Thus, it can decrease a liquid-leakage probability incurred between the cup lid and the cup body, and an accidentally detaching probability of the cup lid away from the cup body.

7 Claims, 5 Drawing Sheets

(56) References Cited

U.S. PATENT DOCUMENTS

| | | | | |
|---|---|---|---|---|
| 4,756,440 | A * | 7/1988 | Gartner | B65D 47/06 220/254.1 |
| 5,253,780 | A * | 10/1993 | Adado | A47G 19/2272 220/737 |
| 5,897,019 | A * | 4/1999 | Stropkay | B65D 43/021 220/669 |
| 11,053,051 | B2 * | 7/2021 | Kuo | D21J 3/02 |
| 2003/0209512 | A1 * | 11/2003 | Guyot | A47G 19/2266 215/388 |
| 2008/0237247 | A1 | 10/2008 | Mucci et al. | |
| 2011/0240666 | A1 * | 10/2011 | Mihaylov | B65D 43/022 220/796 |
| 2016/0029824 | A1 * | 2/2016 | Yiu | B65D 43/022 220/254.1 |

* cited by examiner

SUNKEN-TYPE CUP LID

FIELD OF THE INVENTION

The present invention relates to a technique field of cup lid, and more particularly, to a sunken-type cup lid.

BACKGROUND OF THE INVENTION

In general, a traditional detachable-type cup lid adopts a snap-connection with a cup body. A joining seam existing between the cup lid and the cup body is apt to result in a leakage of a liquid stored within the cup body. In particular, while the cup body is tilted to make the liquid, stored within the cup body, completely contacting with the joining seam between the cup lid and the cup body, the liquid might easily and accidentally flow out of a seam gap between the cup lid and the cup body.

Accordingly, it is essential to provide a sunken-type cup lid having an improved structure, in order to resolve the technical problem incurred for the above-mentioned prior arts.

SUMMARY OF THE INVENTION

Hence, to resolve the technical matters of the above-mentioned prior art, a primarily inventive objective of the present invention is to provide a sunken-type cup lid where a sunken-type dome structure is formed to expand a contacting area (as located adjacent to an joining seam between the cup lid and a cup body), from a leaning-on portion to a camber-holding portion, against the cup body, and thereby decreasing a leakage probability that a liquid stored within the cup body passes through the joining seam.

Besides, another inventive objective of the present invention is to provide a sunken-type cup lid where a leaning-on portion is configured with an outer peripheral sidewall downwardly extended for laterally and tightly fitting onto an inner circumferential sidewall of a cup body, and a camber-holding portion is outwardly extended to downwardly and tightly fitting overneath a cup mouth of the cup body, thereby accomplishing a multi-directional tight-fit effect for making the cup lid snap-covering on the cup body, decreasing a liquid-leakage probability incurred between the cup lid and the cup body and an accidentally-detaching probability of the cup lid away from the cup body, and facilitating convenience and portability of the beverage cups for beverage drinkers' different drinking demands.

Besides, another inventive objective of the present invention is to provide a sunken-type cup lid that is made by die-matching between a couple of male and female moulds in a wet pulp-molding technique to thermally compress a paper pulp, containing plant fibers as primary raw material, in a way of integrally shaping three-dimensional overall sizes of the entire sunken-type cup lid, whereby the sunken-type cup lid constituted by the paper pulp is capable of totally conforming to the modern environmental protection requirements in both biodegradability and compostability aspects.

To accomplish the above-mentioned inventive objectives, the present invention provides a sunken-type cup lid, for covering on a cup mouth of a cup body storing a liquid, which is made by using a wet pulp-molding technique to thermally compress a paper pulp in a way of integrally shaping three-dimensional overall sizes of the entire sunken-type cup lid, and comprises: a covering panel, a leaning-on portion and a camber-holding portion. The leaning-on portion is formed, around an outermost perimeter of the covering panel, with an outer peripheral sidewall downwardly extended to be tightly fitted onto an inner circumferential sidewall of the cup mouth of the cup body in a tight-fit manner. The camber-holding portion is formed around an upper section of the leaning-on portion and outwardly extended to be snap-connected with the cup mouth, wherein the covering panel forms thereon a dome structure, with an upper convex-curved surface, which is upwardly cambered in a specific radian from a bottom of the sunken-type cup lid, to be in a manner that the camber-holding portion, the leaning-on portion and the upper convex-curved surface of the covering panel commonly delimit a sunken chamber, and the upper convex-curved surface forms thereon an uppermost apex and a plurality of low apexes, and the plurality of low apexes that are located along the outermost perimeter of the covering panel are integrally connected with a lowest section of the leaning-on portion, to respectively delimit a plurality of U-shaped cross-sectional bend portions.

In a preferred embodiment according to the present invention, the outer peripheral sidewall of the leaning-on portion has an oblique angle which is consistent with an oblique angle formed on the inner circumferential sidewall of the cup body.

In a preferred embodiment according to the present invention, the sunken-type cup lid further comprises a snap-in portion that is formed around an outer perimeter of the camber-holding portion and downwardly extended.

In a preferred embodiment according to the present invention, the sunken-type cup lid further comprises a buckle, which is disposed on the snap-in portion, protruding toward the cup body.

In a preferred embodiment according to the present invention, the plurality of U-shaped cross-sectional bend portions have a number of different height differences from each other, to be in a way of making a flow diversion effect on the liquid to flow from an upstream to a downstream within the sunken-type cup lid.

In a preferred embodiment according to the present invention, a height where the uppermost apex of the upper convex-curved surface is located is lower than a height where the camber-holding portion is located.

In a preferred embodiment according to the present invention, the sunken-type cup lid further comprises an outlet formed within the covering panel, and the sunken chamber has a storing space for storing the liquid overflowing out of the outlet.

In a preferred embodiment according to the present invention, a height difference between the camber-holding portion and the outlet is larger than a height difference between the camber-holding portion and a centre point of the covering panel.

In a preferred embodiment according to the present invention, the sunken-type cup lid further comprises a drinking spout disposed on the covering panel which is liquid-communicated with the outlet, and an upper section of the drinking spout is formed with a drinking aperture which is located higher than the camber-holding portion, and an outer peripheral sidewall of the drinking spout is downwardly incline-extended to integrally intersect with the upper convex-curved surface of the covering panel, in a way of forming an intersectional boundary, with an obtuse angle, on a bottom of the outer peripheral sidewall of the drinking spout.

In a preferred embodiment according to the present invention, the sunken-type cup lid further comprises a puncturable cap which is integrally formed with the covering panel and rotatably hinges on an edge of the outlet, wherein an outer peripheral sidewall of the puncturable cap is downwardly incline-extended to integrally intersect with the upper convex-curved surface of the covering panel.

In a preferred embodiment according to the present invention, while the sunken-type cup lid covers on the cup mouth of the cup body to be in a way of making the inner circumferential sidewall of the cup mouth of the cup body oppressing an outer peripheral sidewall of the leaning-on portion to inwardly deform, the dome structure of the covering panel constructed of the paper pulp is capable of incurring a rebounding deformation to exert a buffering force on the outer peripheral sidewall of the leaning-on portion.

In a preferred embodiment according to the present invention, the covering panel is formed with a vent thereon.

In comparison with the above-mentioned prior arts, the above-mentioned technical solution according to the present invention has the following merits that: by a sunken-type dome structure, the sunken-type cup lid can expand a contacting area, from a leaning-on portion to a camber-holding portion, located adjacent to an joining seam between the cup lid and the cup body, for tightly fitting against the cup body, and decrease a leakage probability that a liquid stored within the cup body passes through the joining seam; furthermore, by the leaning-on portion and the camber-holding portion both for tightly fitting against the cup body, the sunken-type cup lid can accomplish a multi-directional tight fit for snap-covering on the cup body, thereby decreasing an accidental probability of the cup lid separating away from the cup body so as to accomplish a greatly sealing effect, and facilitating convenience and portability of the beverage cups for beverage drinkers' usage in different situations; moreover, in the present invention, the sunken-type cup lid is made by using a wet pulp-molding technique to thermally compress a paper pulp, which is treated as raw material, in a way of integrally shaping three-dimensional overall sizes of the entire sunken-type cup lid. Thus, it is capable of totally conforming to the modern environmental protection requirements in both biodegradability and compostability aspects.

DESCRIPTION OF THE DIAGRAMS

To more definitely explain respective embodiments or the prior arts, the figures described in the embodiments or the prior art would be simply introduced thereinafter. It should be realized that the following descriptions for the embodiments and their relevant figures are rendered only for exemplifying the present invention but not for defining the claim scope of the present invention.

DETAILED DESCRIPTION OF THE PREFERRED EMBODIMENTS

The respective preferred embodiments and their companying drawings according to the present invention are further described below only for making the person, which has an ordinary skill in a technique art which the present invention pertains to, accomplishing enablement according to the present invention. The respective preferred embodiment exemplified in accordance with the present invention should not be regarded as a limitation to the claim scope of the present invention. In the following descriptions for the present invention, it should be realized that, a variety of directional terms mentioned in the present invention, comprise but do not limit to, such as "center", "upward", "downward", "front", "rear", "left", "right", "top", "bottom", "inside", "outside" and so forth, on the basis of these directional positions or remove indicated relative to the depictions of the attached figures, only for facilitating a simplified description to the present invention but not indicating or hinting that the mentioned device or component has to be located at a specific directional position, or moved in a specific direction. Thus, it should not be realized as the limitations to the claim scope of the present invention. Besides, another terms, such as "first", "second" and so forth are described only for distinguishing objects but not indicating or hinting the amount of some technical characterizations, and therefore the respective technical characterization with respectively specifying the terms "first" and "second" is capable of indicating or hinting that its amount may be just one or multiple of the technical characterization, unless there are definitely and concretely claim-limited to the amount of the respective technical characterization.

First Embodiment

Figure 1:
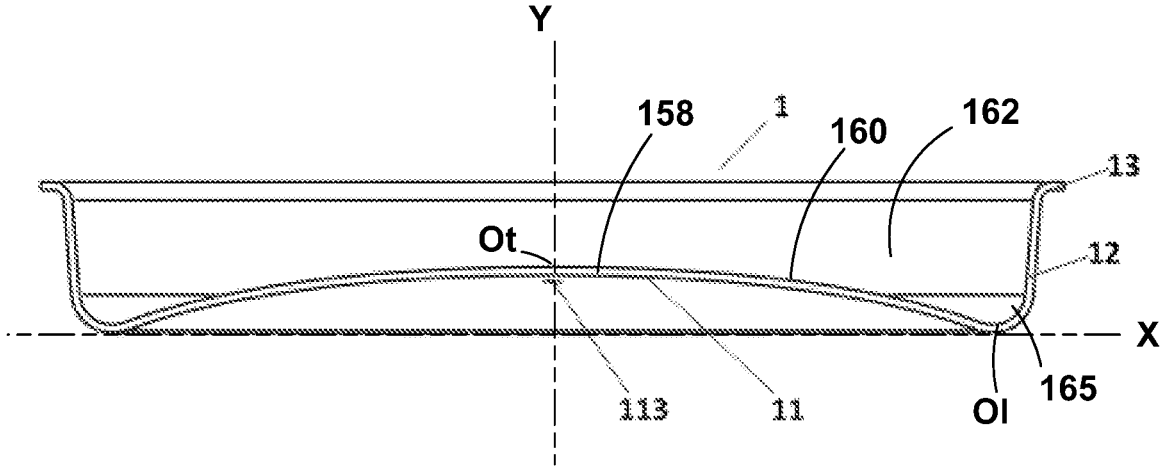
FIG. 1 depicts a schematically cross-sectional diagram of a sunken-type cup lid of a first preferred embodiment according to the present invention.

Please refer to an illustration depicted in FIG. 1, where a sunken-type cup lid 1 of a first preferred embodiment according to the present invention is introduced thereinafter. The sunken-type cup lid 1 is integrally shaped with one of a variety of materials, such as papers, plastics and so forth; preferably, the sunken-type cup lid 1 is made by die-matching between a couple of male and female moulds of a wet pulp-molding technique to thermally compress a paper pulp, which contains plant fibers as primary raw material, in a way of integrally shaping three-dimensional overall sizes of the entire sunken-type cup lid 1, whereby the sunken-type cup lid 1 constituted by the paper pulp is capable of conforming to the modern environmental protection requirements in both biodegradability and compostability aspects.

As referring to the illustration depicted in FIG. 1, the sunken-type cup lid 1, configured for covering on a cup mouth of a cup body 2 (as referring to FIG. 7) that stores a liquid therein, is primarily structured with: a covering panel 11, a leaning-on portion 12 and a camber-holding portion 13, all which are used for constituting the cup lid 1. The leaning-on portion 12 is formed, around an outermost perimeter of the covering panel 11, with an annular outer peripheral sidewall downwardly extended to be laterally and tightly fitted onto an annular inner circumferential sidewall of the cup body 2 (as referring to FIG. 7). And, the camber-holding portion 13 is formed around an upper section of the leaning-on portion 12 and outwardly extended to be downwardly and tightly fitted overneath the cup mouth (as an upper section of an annular rolling edge 21 shown in FIG. 7) for achieving a snap-connection with the cup mouth.

Further referring to the illustration depicted in FIG. 1, the covering panel 11 is shaped as a convexity upwardly cambered in a specific radian from a bottom, located at a horizontal datum axis X, of the sunken-type cup lid 1, thereby forming thereon a sunken-type dome structure 158 having an upper convex-curved surface 160, to be in a manner that the upper convex-curved surface 160, the leaning-on portion 12 and the camber-holding portion 13 of the covering panel 11 commonly delimit a sunken chamber 162. Underneath the dome structure 158 of the covering panel 11, a bottom chamber is defined with a lower concave-curved surface that is located back to back against the upper convex-curved surface 160 and correspondingly neighbors to the liquid stored within the cup body 2 (as referring to FIG. 7). Preferably, the upper convex-curved surface 160 of the covering panel 11 is formed with a vent 113 thereon; preferably, the vent 113 might be located at a centre point Ot of the covering panel 11. In a preferred embodiment, a longitudinal central axis Y is intersected with the horizontal datum axis X at an intersectional point therebetween as treated an origin point, and the longitudinal central axis Y is treated as a gradual-height datum axis. At a highest position of the upper convex-curved surface 160 of the dome structure 158, an uppermost apex that the longitudinal central axis Y is extended through is formed as the centre point Ot of the covering panel 11. And, a height where the uppermost apex Ot is located is lower than a height where the camber-holding portion 13 is located; and simultaneously, the upper convex-curved surface 160 also forms a plurality of low apexes Ol thereon that are respectively located adjacent to an outermost perimeter of the covering panel 11 and lower than the uppermost apex Ot and most structures of the upper convex-curved surface 160. The plurality of low apexes Ol have the same heights and are integrally connected with a lowest section of the leaning-on portion 12 to be in a way of respectively delimiting a plurality of U-shaped cross-sectional bend portions 165, whereas in another embodiment, the plurality of low apexes Ol of the upper convex-curved surface 160 of the covering panel 11 may have different heights and are integrally connected with an annular inner peripheral sidewall of the leaning-on portion 12, so as to respectively delimit the plurality of U-shaped cross-sectional bend portions 165 having different heights starting from the horizontal datum axis X.

In the present embodiment, such a sunken-type design of the dome structure 158 of the covering panel 11 is capable of accomplishing strengthening of the entire structure of the cup lid 1. It concretely comprises: along the longitudinal central axis Y, a structure-strengthening manner is established for up-to-down arranged structures of the sunken-type cup lid 1; and simultaneously, along the horizontal datum axis X, a structure-strengthening manner is established for horizontally-arranged structures of the sunken-type cup lid 1, e.g., from the centre point Ot of the covering panel 11 to the respective U-shaped cross-sectional bend portions 165. Furthermore, while the sunken-type cup lid 1 is snap-covered onto the cup mouth of the cup body 2 (as referring to FIG. 7) in a way of making the inner circumferential sidewall of the cup mouth oppressing the outer peripheral sidewall of the leaning-on portion 12 to inwardly deform. This would facilitate the dome structure 158 of the covering panel 11, which is constructed of the paper pulp, incurring a rebound deformation to exert a buffering force on the outer peripheral sidewall of the leaning-on portion 12, so as to balance an oppressing force applied from the inner circumferential sidewall of the cup mouth, thereby accomplishing the snap-connection therebetween. In that way, the entire sunken-type cup lid 1 would not have a permanent-deformation problem as frequently incurred in a dominating-platform type covering panel of the traditional cup lid upon suffering an external compression.

Besides, on the basis of a stack effect, the dome structure 158 of the covering panel 11 can make the bottom chamber of the covering panel 11 to gather a hot vapor, which is brought from the liquid stored within of the cup body 2 (as referring to FIG. 7), into a center of the bottom chamber, toward a way of vapor-exhausting through the vent 113.

Further referring to the illustration depicted in FIG. 1, the outer peripheral sidewall of the leaning-on portion 12 is revealed with an annular incline surface or annular obconic surface, and is formed around the outermost perimeter of the covering panel 11. After the sunken-type cup lid 1 is snap-covered onto the cup mouth of the cup body 2 (as referring to FIG. 7), the outer peripheral sidewall of the leaning-on portion 12 can be leaned against along the annular inner circumferential sidewall of the cup body 2 (as referring to FIG. 7) to be laterally and tightly fitted onto each other, by such a way that the outer peripheral sidewall of the leaning-on portion 12 has an oblique angle which is consistent with an oblique angle formed on the inner circumferential sidewall of the cup body 2; preferably, an included angle, relative to a vertical direction parallel with the longitudinal central axis Y, of the outer peripheral sidewall of the leaning-on portion 12 is approximate 3°~6°, whereas an optimal one is 4.5°.

Figure 7:
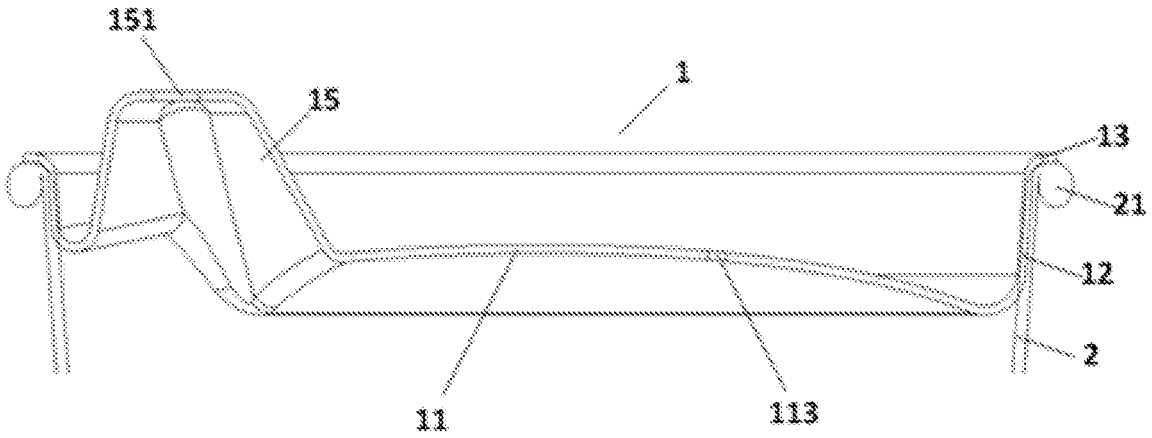
FIG. 7 depicts a schematic diagram of the sunken-type cup lid, covering on a cup body, of the third preferred embodiment according to the present invention.

As illustrated in FIG. 1, an outer diameter of the annular outer peripheral sidewall of the leaning-on portion 12 is larger than an inner opening diameter of the annular inner circumferential sidewall of the cup body 2 (as referring to FIG. 7). The outer peripheral sidewall of the leaning-on portion 12 of the cup lid 1 and the inner circumferential sidewall of the cup body 2 (as referring to FIG. 7) both can face-to-face contact with each other to be fitted in a tight-fit manner, by such a way that the outer diameter of the outer peripheral sidewall of the leaning-on portion 12 is designed in accordance with the inner opening diameter of the cup body 2 (as referring to FIG. 7). Preferably, the outer diameter of the outer peripheral sidewall of the leaning-on portion 12 is 82 mm~84 mm, whereas an optimal outer diameter of the leaning-on portion 12 is 83.85 mm. Preferably, the inner opening diameter of the inner circumferential sidewall of the cup body 2 (as referring to FIG. 7) is 81 mm~83 mm, whereas an optimal inner opening diameter of the cup mouth of the cup body is 82.9 mm.

As illustrated in FIG. 1, if a height measurement starts at the origin point intersected between the horizontal datum axis X and the longitudinal central axis Y regarded as the gradual-height datum axis, a height of the leaning-on portion 12 is larger than a height of the traditional cup lids; preferably, the height of the leaning-on portion 12 is elongated into at least 7 mm or 7.75 mm.

In the present invention, a design of the sunken-type dome structure 158 is capable of greatly expanding a contacting area, from the outer peripheral sidewall, with an elongated height (e.g., 7.75 mm), of the leaning-on portion 12 (as laterally fitting against the inner circumferential sidewall of the cup body 2 shown in FIG. 7) to the camber-holding portion 13 (as downwardly and tightly fitting overneath the cup mouth of the cup body 2 shown in FIG. 7), in tight fit manner between the cup lid 1 and the cup body 2 (as referring to FIG. 7), thereby decreasing a liquid-leakage probability that the liquid stored within the cup body 2 (as referring to FIG. 7) passes out of an joining seam jointed between the cup lid 1 and the cup body 2 (as referring to FIG. 7). The tight fit manner can ensure that it is hard to separate the cup lid 1 away from the cup body 2 (as referring to FIG. 7); particularly, if the liquid stored in between the cup lid 1 and the cup body 2 (as referring to FIG. 7) is a hot water or has a hot vapor, it is essential to ensure that both can still be tightly snap-jointed with each other, for providing the beverage drinkers with a greatly safe protection.

Further referring to the illustration depicted in FIG. 1, the camber-holding portion 13 is shaped, as an annularly-grooved saddle portion, with a downward groove for spraddling over an upper section of an annular rolling edge 21 of the cup mouth of the cup body 2 (as referring to FIG. 7). The camber-holding portion 13 is formed around an upper section of the leaning-on portion 12 and has a downwardly-curved surface that is outwardly extended toward an outermost perimeter of the cup lid 1. An outer diameter of the camber-holding portion 13 is larger than the inner opening diameter of the cup body 2 (as referring to FIG. 7). While the cup lid 1 snap-covers on the cup body 2 (as referring to FIG. 7), the camber-holding portion 13 can be snap-connected with the upper section of the annular rolling edge 21 of the cup mouth of the cup body 2 (as referring to FIG. 7); preferably, a radian of the downwardly-curved surface of the camber-holding portion 13 is consistent with a radian of a downwardly-curved surface of the upper section of the annular rolling edge 21 of the cup body 2 (as referring to FIG. 7), thereby making the downwardly-curved surface of the camber-holding portion 13 downwardly and tightly fitting overneath the downwardly-curved surface of the upper section of the annular rolling edge 21 of the cup body 2 (as referring to FIG. 7). Thus, it can not only raise a multi-directional tightly fitting degree between both the cup lid 1 and the cup body 2 (as referring to FIG. 7), but also increase a contacting area located adjacent to the joining seam between the cup lid 1 and the cup body 2 (as referring to FIG. 7); at the same time, it can also assist the cup lid 1 in seal-covering on the cup body 2 (as referring to FIG. 7).

Second Embodiment

Figure 2:
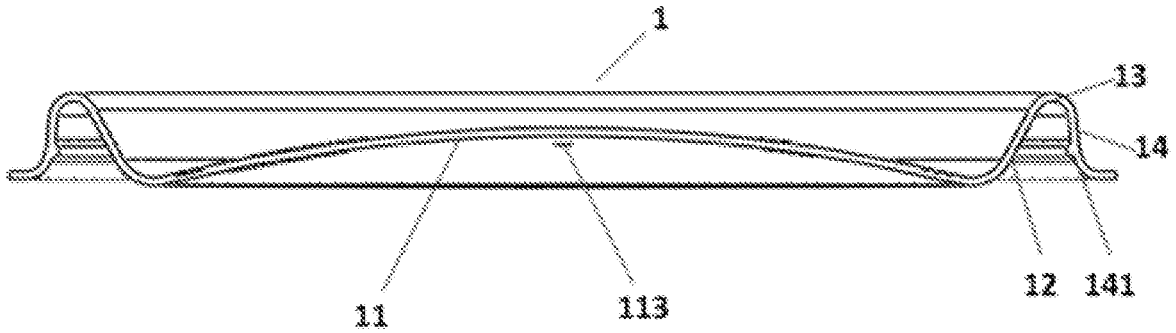
FIG. 2 depicts a schematically cross-sectional diagram of a sunken-type cup lid of a second preferred embodiment according to the present invention.

Please further refer to an illustration depicted in FIG. 2, which depicts a schematically cross-sectional diagram of a sunken-type cup lid 1 of a second preferred embodiment according to the present invention. Compared from the aforementioned first preferred embodiment, there is a difference occurring where: the sunken-type cup lid 1 illustrated in the second preferred embodiment further additionally comprises an annular snap-in portion 14, whereas the rest components (such as the covering panel 11, the vent 113 and so forth) thereof all will be omitted hereunder since being the same as mentioned in the sunken-type cup lid 1 of the first preferred embodiment in their corresponding component structures and functions. Preferably, the snap-in portion 14 is formed around an outer perimeter of the camber-holding portion 13 and downwardly extended.

In details as illustrated in FIG. 2, an upper section of the snap-in portion 14 is integrally connected with the outer perimeter of the camber-holding portion 13. A lower section of the snap-in portion 14 is downwardly and outwardly extended toward the outermost perimeter of the sunken-type cup lid 1. Meanwhile, the snap-in portion 14, the camber-holding portion 13 and the leaning-on portion 12 (namely the three components) commonly delimit an accommodating chamber for fully accommodating the annular rolling edge 21 of the cup mouth of the cup body 2 (as referring to FIG. 7) to be in a manner that at least one portion (as two spaced inner lateral sidewalls of the accommodating chamber) of the accommodating chamber can be tightly fitted onto (as referring to FIG. 7) either of the inner and outer circumferential sidewalls of the cup body 2. Thus, the snap-in portion 14 is capable of increasing a contacting area between the cup lid 1 and the cup body 2 (as referring to FIG. 7), keeping a stability of a snap-in retention between the cup lid 1 and the cup body 2 (as referring to FIG. 7), decreasing an accidentally-detaching probability between both the cup lid 1 away from the cup body 2 (as referring to FIG. 7) in usage, and avoiding the liquid leakage incurred between both the cup lid 1 and the cup body 2 (as referring to FIG. 7).

As the second preferred embodiment depicted in FIG. 2, the snap-in portion 14 of the sunken-type cup lid 1 further comprises a buckle 141 which protrudes, from the annular inner peripheral sidewall of the snap-in portion 14, in a direction toward the cup body 2 (as referring to FIG. 7). The buckle 141 may be discontinuously disposed, in an annularly distribute manner, around the annular inner peripheral sidewall of the snap-in portion 14, or is disposed as an annular bar around one of the two inner lateral sidewalls of the accommodating chamber.

In more details as illustrated in FIG. 2, the buckle 141 is configured for accomplishing a tight snap-in retention between the cup lid 1 and the cup mouth of the cup body 2 (as referring to FIG. 7). While the cup lid 1 covers on the cup body 2 (as referring to FIG. 7), the buckle 141 protrudes to be snapped into underneath a lowest section of the annular rolling edge 21 of the cup mouth of the cup body 2 (as referring to FIG. 7), to be in a way of temporarily retaining the annular rolling edge 21 of the cup body 2 (as referring to FIG. 7) within the accommodating chamber of the cup lid 1, and further raising a stability under a covering or connection manner between the cup lid 1 and the cup body 2 (as referring to FIG. 7).

As illustrated in FIG. 2, the buckle 141 has a protruding length that does not exceed a cross-sectional diameter of the annular rolling edge 21 of the cup body 2 (as referring to FIG. 7). The buckle 141 and the accommodating chamber (as comprising the snap-in portion 14, the camber-holding portion 13 and the leaning-on portion 12) commonly define a restrictive space that can permit the annular rolling edge 21 of the cup body 2 (as referring to FIG. 7) having a limited removal. At the same time when the stability under the covering or connection manner between the cup lid 1 and the cup body 2 (as referring to FIG. 7) is raised, it will not be involved in manually separating the cup lid 1 away from the cup body 2 (as referring to FIG. 7).

Third Embodiment

Figure 3:
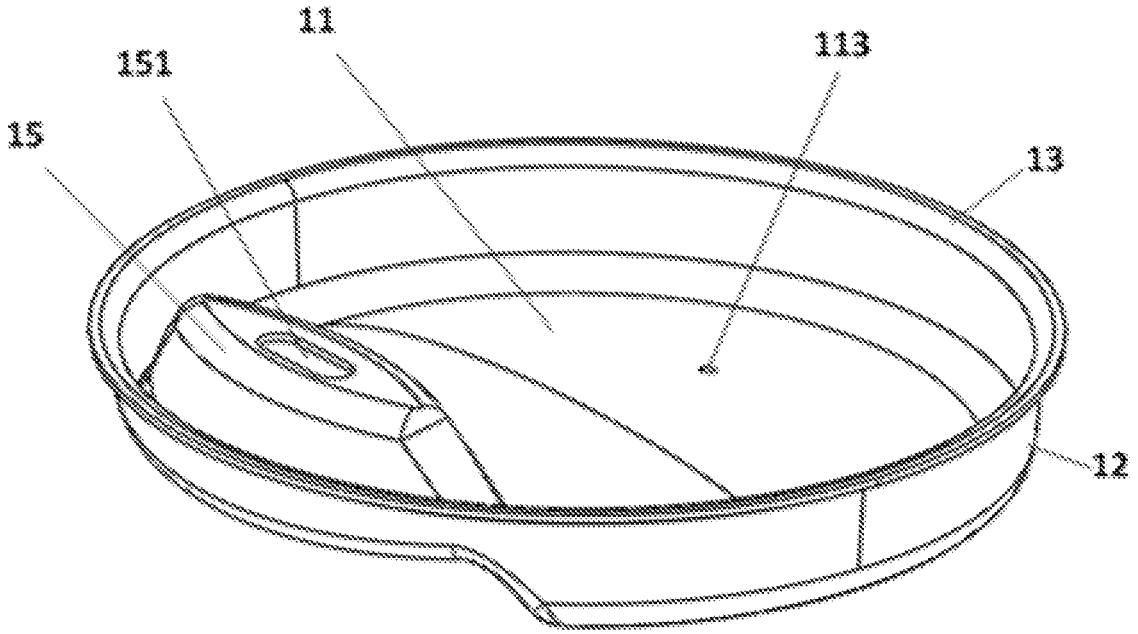
FIG. 3 depicts a schematic diagram of a sunken-type cup lid, with a drinking spout, of a third preferred embodiment according to the present invention.
Figure 4:
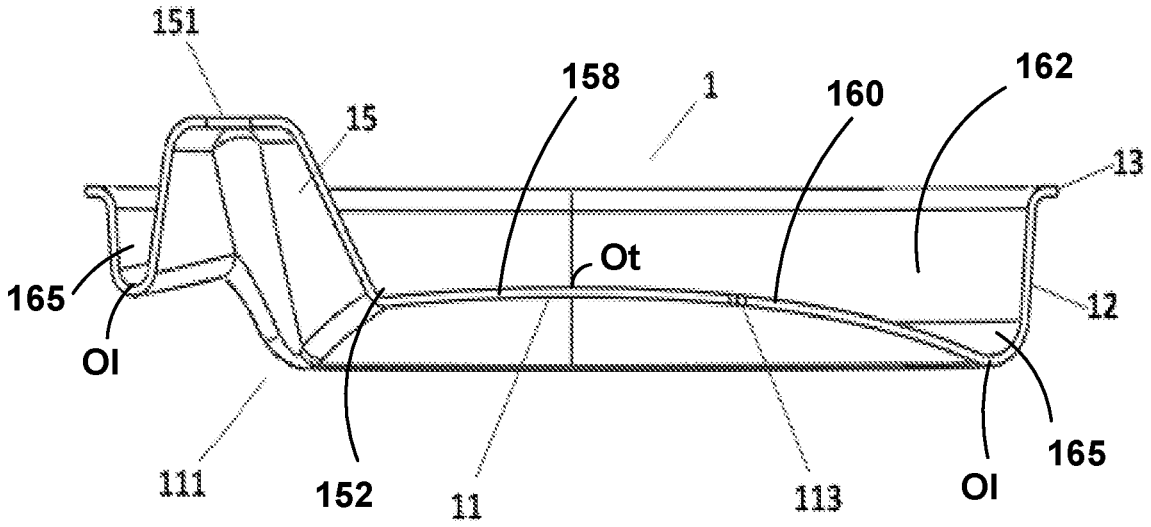
FIG. 4 depicts a schematically cross-sectional diagram of the sunken-type cup lid, with the drinking spout, of the third preferred embodiment according to the present invention.

Please further refer to an illustration depicted in FIGS. 3~4 & 7, wherein FIG. 3 depicts a schematic diagram of a sunken-type cup lid 1, with a drinking spout, of a third preferred embodiment according to the present invention, and FIG. 4 depicts a schematically cross-sectional diagram of the sunken-type cup lid 1, with the drinking spout, of the third preferred embodiment according to the present invention. Compared with the sunken-type cup lid 1 of the aforementioned first preferred embodiment, there is a difference occurring where the sunken-type cup lid 1 of the third preferred embodiment further additionally comprises an outlet 111, whereas the rest components (such as the covering panel 11, the vent 113 and so forth) thereof all will be omitted hereunder since being the same as mentioned in the sunken-type cup lid 1 of the first preferred embodiment in their corresponding component structures and functions. The outlet 111 is formed on a lower concave-curved surface of the bottom chamber of the covering panel 11, to be upwardly extended through the upper convex-curved surface 160 of the covering panel 11. The outlet 111 is capable of making the liquid, stored within the cup body 2 (as referring to FIG. 7), flowing outside/being released from the cup lid 1, or being absorbed by the beverage drinker's mouth.

As illustrated in FIGS. 3~4 and FIG. 7, the camber-holding portion 13, the leaning-on portion 12 and the upper convex-curved surface 160 of the covering panel 11 commonly delimit a sunken chamber 162. The sunken chamber 162 further has a storing space for storing a part of the liquid which overflow from the cup body 2. In a case, while a beverage drinker's drinking carelessly makes the liquid partially overflowing out of the outlet 111 or the drinking spout 15, the storing space, with an enlarged storing volume, of the sunken chamber 162 is capable of storing more overflowing liquid, by a way of preserving the overflowing liquid at a number of lowest positions within the sunken chamber 162 of the cup lid 1 (e.g., the U-shaped cross-sectional bend portions 165 located at the lowest positions within the sunken chamber 162), so as to avoid the liquid overflowing to dirty the cup body 2, or further polluting its surroundings. Preferably, the upper convex-curved surface 160 of the covering panel 11 is formed with a vent 113 therethrough.

As the present preferred embodiment depicted in FIGS. 3~4, each height from the camber-holding portion 13 to the leaning-on portion 12 all are larger than a corresponding height of a traditional cup lid in general. Accordingly, this makes that the storing volume of the storing space, for storing the overflowing liquid, of the sunken chamber 162 is also larger than a storing volume of an upper surface of the traditional cup lid, thereby being capable of storing more overflowing liquid than the traditional cup lid, and hardly causing a problem that the overflowing liquid flows outside the cup lid 1, or further burns the beverage drinker. By that way, the storing space of the sunken chamber 162 of the cup lid 1 can have a deeper depth which is sufficient to accommodate the beverage drinker's nose upon the beverage drinker drinking, so as to avoid the beverage drinker's the nose knocking against the cup lid 1. Thus, it can raise a better useful feeling for the beverage drinker in drinking.

As the present preferred embodiment depicted in FIG. 4, with such a sunken-type design of the dome structure 158, a height difference between the camber-holding portion 13 and the outlet 111 is larger than a height difference between the camber-holding portion 13 and the centre point Ot of the covering panel 11. It means that a sunken-height difference from the outlet 111 to the centre point Ot of the covering panel 11 is formed for the sunken-type design. Variation of such a sunken-height difference for the dome structure 158 is utilized to increase a lip-holding area of the cup lid 1 for the beverage drinker's drinking, in a way of raising a usability thereof.

As the present preferred embodiment depicted in FIGS. 3~4 and FIG. 7, an upper convex-curved surface 160 of the covering panel 11 further forms thereon a tube-shaped or taper-profile drinking spout 15 that is upwardly protruded with a hollow defined therethrough. A bottom of the drinking spout 15 is liquid-communicated with the outlet 111. An upper section of the drinking spout 15 further forms thereon a drinking aperture 151 which is used as a liquid exit or for the beverage drinker's directly drinking. Accordingly, the liquid flowing out of the outlet 111 can pass through an internal channel of the drinking spout 15 to further flow outside the drinking aperture 151. While the beverage drinker would like to drink the liquid stored within the cup body, the beverage drinker can lip-hold the drinking spout 15 to drink/absorb the liquid via the internal channel of the drinking spout 15.

As the present preferred embodiment depicted in FIGS. 3~4, a position where the drinking aperture 151 is located is higher than the camber-holding portion 13, namely a manner that a top portion of the drinking spout 15 is higher than an outermost edge of the cup lid 1. A higher height of the drinking spout 15 can increase a lip-holding area on the drinking spout 15 for the beverage drinker's drinking, in accompanying an accommodating-nose space of a sunken chamber 162, and optimizing the drinking feeling for the beverage drinker.

As the present preferred embodiment depicted in FIGS. 3~4 & 7, an outer peripheral sidewall of the drinking spout 15 is downwardly incline-extended to integrally intersect with the upper convex-curved surface 160 of the dome structure 158 of the covering panel 11, for both commonly rendering an intersectional connection of an incline plane with a curved surface thereon (See FIG. 4), to be in a way of forming an intersectional boundary, with an obtuse angle 152, on a bottom of the outer peripheral sidewall of the drinking spout 15. The intersectional boundary having the obtuse angle 152 is capable of further increasing the storing volume of the sunken chamber 162 for storing the liquid overflowing out of the cup body 2.

As the present preferred embodiment depicted in FIGS. 3~4, heights of some of the U-shaped cross-sectional bend portions 165, which are located adjacent to/around the bottom of the drinking spout 15, are higher than heights of the other U-shaped cross-sectional bend portions 165 which are located at other different positions of the cup lid 1, to be in a of way of creating different height differences therebetween. It means that heights of some of the low apexes Ol located around the outermost perimeter of the covering panel 11 have height differences from the others. By the different height difference between the U-shaped cross-sectional bend portions 165 respectively located at these different positions along the outermost perimeter of the covering panel 11, it can make a flow diversion effect on the overflowing liquid, from an upstream to a downstream within the sunken-type cup lid 1, namely having a capability of guiding and gathering the overflowing liquid to flow toward a space located at the lowest position within the sunken chamber 162 of the covering panel 11. In a case as depicted in FIG. 4, one of the low apexes Ol, which is located at a right side (as a downstream located at the lowest position) of the upper convex-curved surface 160, is lower than the other low apexes Ol located at a left side (as an upstream located at a higher position) of the upper convex-curved surface 160, such that the low apexes Ol located on the right side (as the downstream located at the lowest position) of the upper convex-curved surface 160 can easily guide and gather the liquid overflowing out of the drinking spout 15.

As illustrated in FIG. 7, for the cup lid 1 snap-covering onto the cup body 2 (as referring to FIG. 7), the camber-holding portion 13 of the cup lid 1 forms a downwardly-curved surface which is extended outwardly, in a specific arc-length, with a radian approximating to a radian formed on an downwardly-curved surface of a topside edge of the annular rolling edge 21 of the cup mouth of the cup body 2, whereby while the downwardly-curved surface of the camber-holding portion 13 downwardly contacts with the downwardly-curved surface of the annular rolling edge 21 of the cup body 2, the downwardly-curved surface of the camber-holding portion 13 can downwardly and tightly fit overneath the downwardly-curved surface of the annular rolling edge 21 of the cup body 2. Simultaneously, since each height from the camber-holding portion 13 to the leaning-on portion 12 is further larger than a height of the traditional cup lid in general, it would greatly enlarge and elongate a contacting area, from the camber-holding portion 13 to the leaning-on portion 12 in the cup lid 1, against the inner circumferential sidewall of the cup body 2. Accordingly, it can effectively prevent the liquid, stored within the cup body 2, from leakage toward the outside.

Fourth Embodiment

Figure 5:
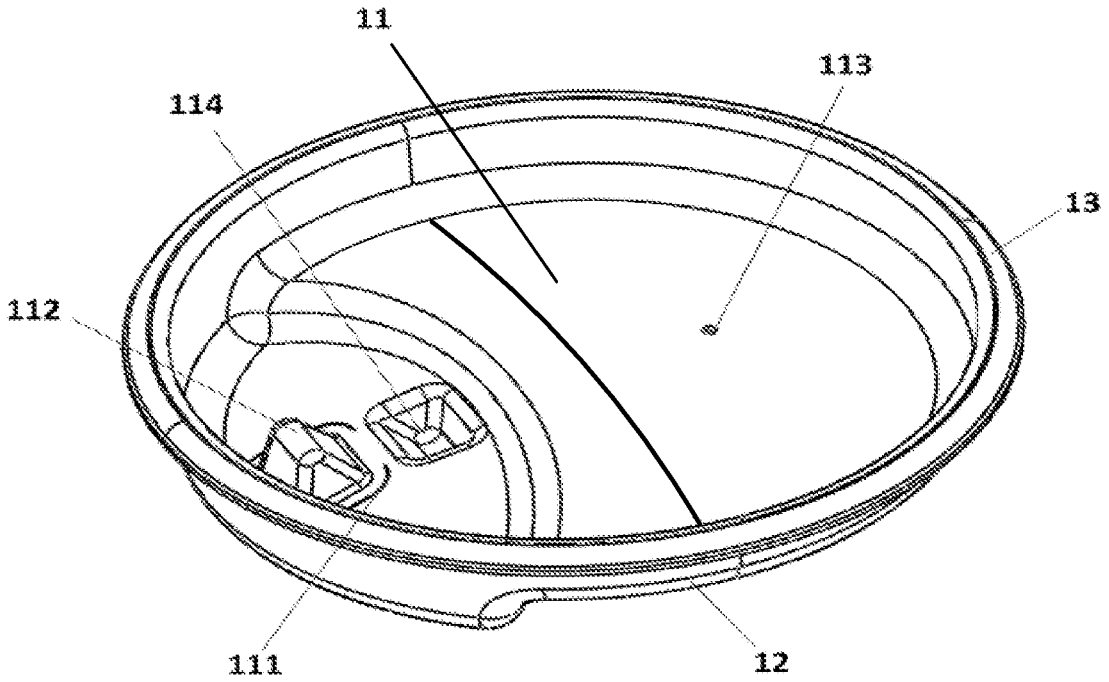
FIG. 5 depicts a schematic diagram of a sunken-type cup lid, with a puncturable cap, of a fourth preferred embodiment according to the present invention.
Figure 6:
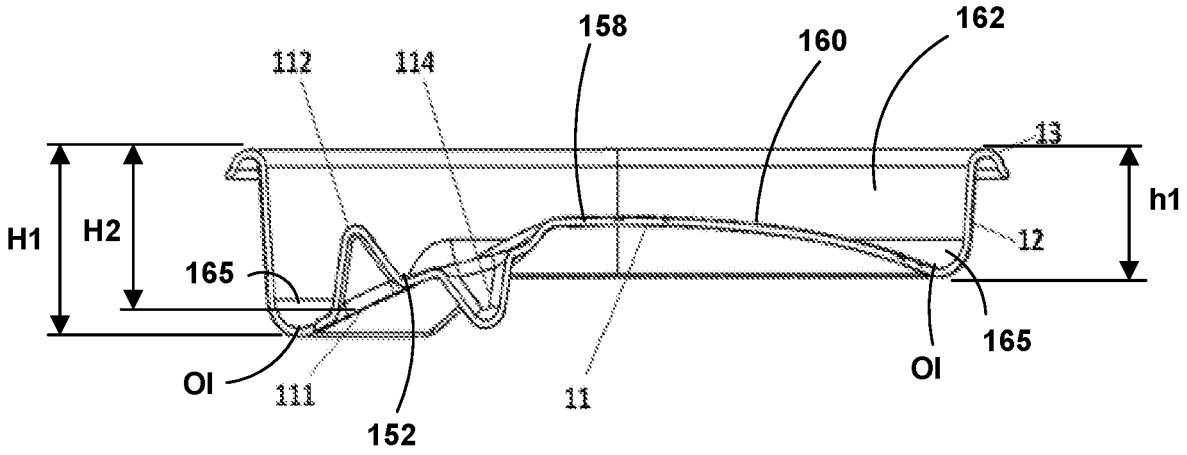
FIG. 6 depicts a schematically cross-sectional diagram of the sunken-type cup lid, with the puncturable cap, of the fourth preferred embodiment according to the present invention.

Please refer to an illustration depicted in FIGS. 5~6, wherein FIG. 5 depicts a schematic diagram of a sunken-type cup lid 1, with a puncturable cap 112, of a fourth preferred embodiment according to the present invention, and FIG. 6 depicts a schematically cross-sectional diagram of the sunken-type cup lid 1, with the puncturable cap 112, of the fourth preferred embodiment according to the present invention. Compared with the sunken-type cup lid 1 of the above-mentioned third preferred embodiment, there is a difference existing where: the sunken-type cup lid 1 of the fourth preferred embodiment further comprises the puncturable cap 112 (as configured for replacing the drinking spout 15 of the above-mentioned third preferred embodiment depicted in FIG. 3) which is laterally and rotatably hinging onto a connecting edge of the outlet 111, whereas the rest components (such as the covering panel 11, the vent 113 and so forth) thereof all will be omitted hereunder since being the same as mentioned in the sunken-type cup lid 1 of the third preferred embodiment in their corresponding component structures and functions. The puncturable cap 112 can be manually separated away from a separable edge of the outlet 111 for the beverage drinker's drinking. By the way of manually separating the puncturable cap 112 away from the separable edge of the outlet 111, the outlet 111 will be exposed outside to be directly treated as a drinking aperture. Preferably, a recess 114 is formed, adjacent to the connecting edge of the outlet 111, on the upper convex-curved surface 160, for a manner that after the puncturable cap 112 is manually separated away from the separable edge of the outlet 111, the puncturable cap 112 is capable of rotatably hinging on the connecting edge to be temporarily positioned (as stored) within the recess 114. Preferably, the upper convex-curved surface 160 of the covering panel 11 is further formed with a vent 113 thereon.

As the present preferred embodiment depicted in FIGS. 5~6, the puncturable cap 112 and the recess 114 both are constructed with the paper pulp as the raw material, and are integrally formed with the covering panel 11 of the cup lid 1. An outer peripheral sidewall of the puncturable cap 112 and an inner circumferential sidewall of the recess 114 both are incline-extended (e.g., toward upwardly or/and downwardly extending direction) to integrally intersect with the upper convex-curved surface 160 of the dome structure 158 of the covering panel 11 (See FIG. 6). In further speaking, as illustrated in FIGS. 5~6, the outer peripheral sidewall of the puncturable cap 112 is downwardly incline-extended to integrally intersect with the upper convex-curved surface 160 of the covering panel 11, as commonly rendering a connection of an incline plane with a curved surface thereon (See FIG. 6), in a way of forming an intersectional boundary 152 on a bottom of the outer peripheral sidewall of the puncturable cap 112. The intersectional boundary 152 is capable of further enlarging the storing volume of the sunken chamber 162 for the liquid overflowing out of the cup body 2.

As illustrated in FIGS. 5~6, for the beverage drinker easily lip-holding an edge of the cup lid 1 to drink, a height difference H1 is designed longer from the camber-holding portion 13 (as treated as a height-datum line) to some of the U-shaped cross-sectional bend portions 165 located at the lowest positions of the outermost perimeter of the covering panel 11 such that it can increase the lip-holding area on the cup lid 1 for the beverage drinker's drinking, and raise its usability. Besides, by such a sunken-type design of the dome structure 158 of the covering panel 11 of the cup lid 1 according to the present invention, the U-shaped cross-sectional bend portion 165 located around the outermost perimeter of the covering panel 11 are formed as an annular flow diversion recess 165 surrounding the outermost perimeter of the covering panel 11. If the liquid stored within the cup body 2 (as referring to FIG. 7) partially overflows out of the outlet 111, the overflowing liquid can be guided and gathered to enter into the U-shaped cross-sectional bend portion 165 (namely the annular flow diversion recess 165) around the outermost perimeter of the covering panel 11, by way of different sunken-height differences formed on the dome structure 158 of the covering panel 11. In a case, as the present preferred embodiment depicted in FIGS. 5~6, a height difference H2 is formed from the camber-holding portion 13 (as the height-datum line) to the outlet 111 (as a bottom of the puncturable cap 112), and the other U-shaped cross-sectional bend portions 165 located at the other positions of the cup lid 1 have a height difference h1 (from the camber-holding portion 13 as the height-datum line), wherein H1>H2>h1. By the different sunken-height differences respectively formed on the U-shaped cross-sectional bend portions 165 located at different positions around the outermost perimeter of the covering panel 11 (or the low apexes Ol located at different positions around the outermost perimeter of the upper convex-curved surface 160 of the covering panel 11), it can make a flow diversion effect from an upstream to a downstream within the sunken-type cup lid, namely guiding and gathering the overflowing liquid to flow toward a space overneath the low apexes Ol located within the sunken chamber 162 of the covering panel 11. In a case illustrated in FIG. 6, the height difference H2 of one of the U-shaped cross-sectional bend portions 165 (as the low apexes Ol) located on a left side (as the downstream) of the upper convex-curved surface 160 is larger than the height difference h1 of the U-shaped cross-sectional bend portion 165 (as the low apexes Ol) located on a right side (as the upstream) of the upper convex-curved surface 160, such that the overflowing liquid would be guided and gathered to flow toward the U-shaped cross-sectional bend portions 165 (as the low apexes Ol) located on the left side (as the downstream) of the upper convex-curved surface 160.

Fifth Embodiment

Figure 8:
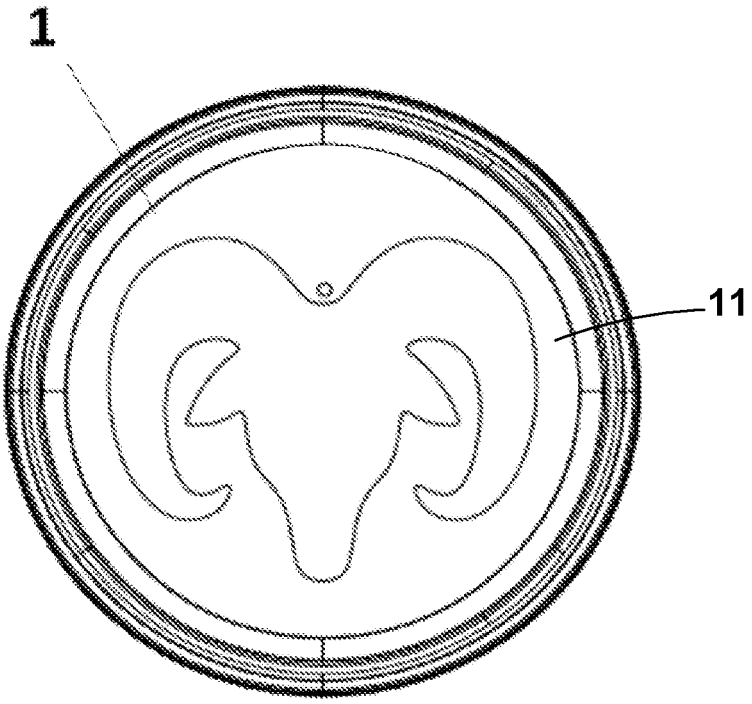
FIG. 8 depicts a schematic top view of a sunken-type cup lid, where a covering panel is patterned in an astrological sign, according to the present invention.
Figure 9:
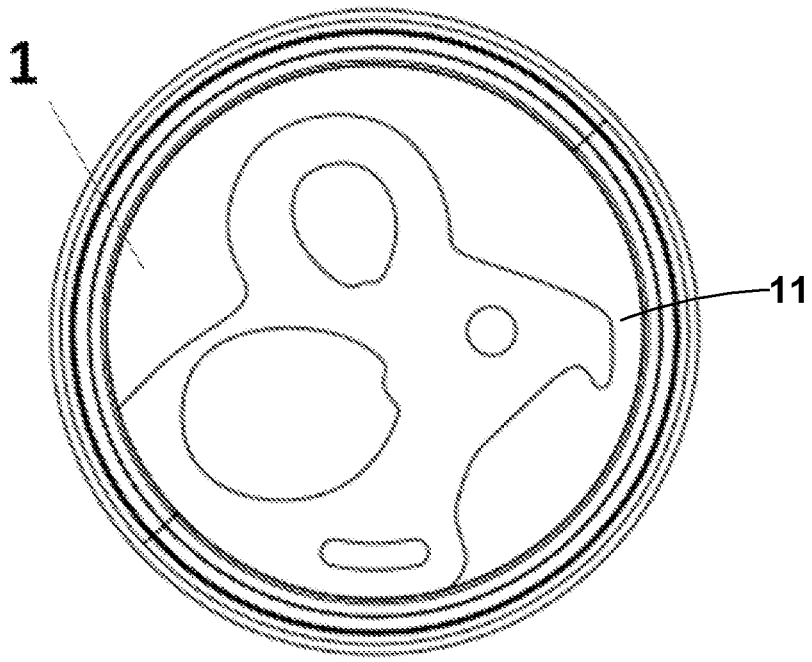
FIG. 9 depicts a schematic top view of another sunken-type cup lid, where a covering panel is patterned in a Chinese zodiac sign (e.g., a rat), according to the present invention.

Please further refer to illustrations depicted in FIGS. 8~9. Compared with the sunken-type cup lid 1 of the above-mentioned respective preferred embodiments, there is a difference existing where: a decorative sign is patterned on an upper surface of the covering panel 11 of the sunken-type cup lid 1. The decorative sign comprises, but is not limited to, for example, twelve astrological signs, twelve Chinese zodiac signs and so forth. In a case depicted in FIG. 8, the upper surface of the covering panel 11 is decoratively patterned thereon with one of twelve astrological signs, like an Aries sign; in another case depicted in FIG. 9, the upper surface of the covering panel 11 is decoratively patterned thereon with one of twelve Chinese zodiac sign, like a Rat sign. Accomplishment of various signs patterned on the covering panel 11 can adopt a printing technique, an integrally-molding technique and the other prior technique but does not affect the entire structure of the cup lid 1.

The respective sunken-type cup lid 1 respectively depicted in FIGS. 1-9 all is made by thermally compressing a wet paper pulp containing plant fibers (such as bagasses, bamboo fibers and so forth) as a primary raw material, through die-matching (e.g., a one-time thermal compression) between a couple of male and female moulds of a wet pulp-molding technique, to be in a way of integrally shaping three-dimensional overall sizes of the entire sunken-type cup lid 1. Meanwhile, in addition that the drinking spout 15, the outlet 111 (see FIG. 4), the puncturable cap 112 and the recess 114 (see FIG. 6) of the covering panel 11 are integrally shaped with positive/negative draft angles and the buckle 141 (see FIG. 2) is integrally shaped with a negative draft angle, with relation to a draft direction of the coupled male and female moulds, the other portions of the sunken-type cup lid 1 all are integrally shaped with a positive draft angle with relation to the draft direction of the coupled male and female moulds. However, in another embodiment, the drinking spout 15, the outlet 111 (see FIG. 4), the puncturable cap 112 and the recess 114 (see FIG. 6) of the covering panel 11 might be integrally shaped with positive draft angles with relation to the draft direction of the coupled male and female moulds.

In comparison with the prior arts, the above-mentioned technical solution according to the present invention has the following merits that:

the sunken-type cup lid 1 according to in the present invention, adopts the sunken-type dome structure 158 to expand/enlarge the contacting area, from the outer peripheral sidewall of the leaning-on portion 12 (as laterally and tightly fitting against the inner circumferential sidewall of the cup body 2) to the downwardly-curved surface of the camber-holding portion 13 (as downwardly and tightly fitting overneath the downwardly-curved surface of the annular rolling edge 21 of the cup mouth of the cup body 2), between the cup lid 1 and the cup body 2, so as to accomplish a multi-directional tight-fit effect for making the cup lid 1 being snap-connected with the cup mouth of the cup body 2, decrease a liquid-leakage probability incurred between the cup lid 1 and the cup body 2 and an accidentally-detaching probability of the cup lid 1 away from the cup body 2, and facilitate convenience and portability of the beverage cups for different drinking demands. Furthermore, the sunken-type cup lid 1 according to the present invention is made by thermally compressing the paper pulp treated as a raw material, through a die-matching between the coupled male and female moulds in the wet pulp-molding technique, to be in a way of integrally shaping three-dimensional overall sizes of the entire sunken-type cup lid 1. Thus, it is capable of totally conforming to the modern environmental protection requirements in both biodegradability and compostability aspects.

In conclusion, although the present invention is described with the respective preferred embodiments as described above, those skilled in the art will appreciate that various modifications, additions, and substitutions are possible without departing from the scope and the spirit of the invention. Accordingly, the scope of the present invention is intended to be defined only by reference to the claims.

What is claimed is:

1. A sunken-type cup lid, for covering on a cup mouth of a cup body storing a liquid, which is made by using a wet pulp-molding technique to thermally compress a paper pulp in a way of integrally shaping three-dimensional overall sizes of the entire sunken-type cup lid, comprising:

a covering panel;

a leaning-on portion, formed around an outermost perimeter of the covering panel and having an outer peripheral sidewall downwardly extended to be tightly fitted onto an inner circumferential sidewall of the cup body in a tight-fit manner;

an outlet, formed within the covering panel;

a drinking spout, disposed on the covering panel and liquid-communicated with the outlet; and a camber-holding portion, formed around an upper section of the leaning-on portion and outwardly extended to downwardly and tightly fit overneath the cup mouth; and wherein the covering panel forms thereon a dome structure, with an upper convex-curved surface, which is upwardly cambered in a specific radian from a bottom of the sunken-type cup lid, to be in a manner that the camber-holding portion, the leaning-on portion and the upper convex-curved surface of the covering panel commonly delimit a sunken chamber with a storing space for storing the liquid overflowing out of the outlet, and the upper convex-curved surface forms thereon an uppermost apex and a plurality of low apexes, and the plurality of low apexes that are located along the outermost perimeter of the covering panel are integrally connected with a lowest section of the leaning-on portion, to respectively delimit a plurality of U-shaped cross-sectional bend portions, wherein an upper section of the drinking spout is formed with a drinking aperture which is located higher than the camber-holding portion, and an outer peripheral sidewall of the drinking spout is downwardly incline-extended to integrally intersect with the upper convex-curved surface of the covering panel, in a way of forming an intersectional boundary, with an obtuse angle, on a bottom of the outer peripheral sidewall of the drinking spout.

2. The sunken-type cup lid according to claim 1, wherein the outer peripheral sidewall of the leaning-on portion has an oblique angle which is consistent with an oblique angle formed on the inner circumferential sidewall of the cup body.

3. The sunken-type cup lid according to claim 1, wherein a height where the uppermost apex of the upper convex-curved surface is located is lower than a height where the camber-holding portion is located.

4. The sunken-type cup lid according to claim 1, wherein a height difference between the camber-holding portion and the outlet is larger than a height difference between the camber-holding portion and a centre point of the covering panel.

5. The sunken-type cup lid according to claim 1, wherein while the sunken-type cup lid covers on the cup mouth of the cup body to be in a way of making the inner circumferential sidewall of the cup mouth of the cup body oppressing an outer peripheral sidewall of the leaning-on portion to inwardly deform, the dome structure of the covering panel constructed of the paper pulp is capable of incurring a rebounding deformation to exert a buffering force on the outer peripheral sidewall of the leaning-on portion.

6. The sunken-type cup lid according to claim 1, wherein the covering panel is formed with a vent thereon.

7. A sunken-type cup lid, for covering on a cup mouth of a cup body storing a liquid, which is made by using a wet pulp-molding technique to thermally compress a paper pulp in a way of integrally shaping three-dimensional overall sizes of the entire sunken-type cup lid, comprising:

a covering panel;

a leaning-on portion, formed around an outermost perimeter of the covering panel and having an outer peripheral sidewall downwardly extended to be tightly fitted onto an inner circumferential sidewall of the cup body in a tight-fit manner;

an outlet, formed within the covering panel;

a drinking spout, disposed on the covering panel and liquid-communicated with the outlet; and a camber-holding portion, formed around an upper section of the leaning-on portion and outwardly extended to downwardly and tightly fit overneath the cup mouth, wherein the covering panel forms thereon a dome structure, with an upper convex-curved surface, which is upwardly cambered in a specific radian from a bottom of the sunken-type cup lid, to be in a manner that the camber-holding portion, the leaning-on portion and the upper convex-curved surface of the covering panel commonly delimit a sunken chamber with a storing space for storing the liquid overflowing out of the outlet, and the upper convex-curved surface forms thereon an uppermost apex and a plurality of low apexes, wherein the plurality of low apexes are integrally connected with a lowest section of the leaning-on portion, along the outermost perimeter of the covering panel, to respectively delimit a plurality of U-shaped cross-sectional bend portions, and include one low apex located nearby the drinking spout and another low apex located far away from the drinking spout, in a manner that the one nearby low apex is higher than the another far-away low apex to make a flow diversion effect on the liquid overflowing out of the outlet of the drinking spout, from an upstream where is the one nearby low apex, to a downstream where is the another far-away low apex, within the storing space of the sunken chamber of the sunken-type cup lid.

* * * * *